US005325435A

United States Patent [19]

Date et al.

[11] Patent Number: 5,325,435

[45] Date of Patent: Jun. 28, 1994

[54] SOUND FIELD OFFSET DEVICE

[75] Inventors: Toshihiko Date, Yamatokoriyama; Shuji Saiki, Nara; Kazuki Honda, Katano, all of Japan

[73] Assignee: Matsushita Electric Industrial Co., Ltd., Osaka, Japan

[21] Appl. No.: 896,175

[22] Filed: Jun. 10, 1992

[30] Foreign Application Priority Data

Jun. 12, 1991 [JP] Japan ..... 3-139921
Dec. 4, 1991 [JP] Japan ..... 3-320176

[51] Int. Cl.[5] ..... H04R 5/00

[52] U.S. Cl. ..... 381/1; 381/66; 381/86; 381/98; 381/97; 381/99; 381/100

[58] Field of Search ..... 381/1, 86, 66, 98, 97, 381/154, 99, 100, 103

[56] References Cited

U.S. PATENT DOCUMENTS 4,355,203 10/1982 Cohen ..... 381/1
4,458,362 7/1984 Berkovitz et al. ..... 381/103
4,703,502 10/1987 Kasai et al. ..... 381/86
5,031,220 7/1991 Takagi ..... 381/86

OTHER PUBLICATIONS

J & R Music World Catalogue, p. 46, copyright 1991.

*Primary Examiner*—Curtis Kuntz
*Assistant Examiner*—Mark D. Kelly
*Attorney, Agent, or Firm*—Ratner & Prestia

[57] ABSTRACT

A sound field offset device having two channels, each of which includes a frequency selection filter for dividing a stereophonic input signal into two frequency bands by a given frequency falling within an audio frequency, at least one digital filter for performing sound field offsetting within a lower frequency band, and at least one loudspeaker assembly for a higher frequency band having a sharp directivity pattern and capable of defining an area to which acoustic power is emitted. This device allows a sound field to be offset in a cost effective and simple manner, by improving the frequency characteristic of a sound field space and by clarifying the sense of locality of acoustic images.

17 Claims, 12 Drawing Sheets

SOUND FIELD OFFSET DEVICE

BACKGROUND OF THE INVENTION

1. Field of the Invention

The present invention relates to a sound field offset device which is applied, in sound reproducing, to a sound field where reflected sound waves and the like may adversely affect frequency characteristics and locality of acoustic images sensed at a listening position.

2. Description of the Prior Art

In sound reproducing, reflected sounds may occasionally be a major cause disturbing the frequency characteristic at a listening position, and impeding a sense of locality of acoustic images. In a car's closed space, in particular, direct sound waves are greatly disturbed by first or second reflected sounds existing in a sound field inside a car, because the size of the car's space is small, and reflector walls such as glass windows usually exist nearby the listening position.

FIG. 1 shows a calculated value of an echo pattern changing with time in the sound field of the car's internal space. It can be seen that a major group of reflected sound waves concentrates with a delay of 2 ms to 3 ms in succession to the direct sound wave. The order of the delay time noticed in the above response is similar to the one derived from the spatial separation between both ears. These reflected sound waves interfere with the direct sound wave in phase, disturb the frequency characteristics at the listening point, and destroy the sense of locality of acoustic images. A graphic equalizer employing analog filters which has been conventionally used as a sound field offset device cannot improve the sense of locality of acoustic images. The reason for this is that although the graphic equalizer can offset the amplitude characteristic of sounds up to a flat or any required characteristic, it cannot control the phase characteristic of sounds. Recently, an attempt to offset sound field has been made by controlling the phase characteristic of sounds by means of a digital filter technique. Such a technique has achieved an improvement in the frequency characteristic of a sound field where the effect of reflected sound waves is noticeably strong and an improvement in the sense of locality of acoustic images in an asymmetrical sound field such as the sound field in the car's space.

Since high frequency response plays an important role in the locality of acoustic images, this response should also be subjected to the sound field offset even when the sound field offset is performed by means of the digital filter technique. Signal processing up to the audio frequency band, however, requires a higher sampling frequency and fast arithmetic speed in the filter, thus increasing a burden on hardware design. Although it may be theoretically possible to handle the entire audio frequency band with the digital filter, a great deal of difficulty may arise in implementing such a scheme from the standpoint of cost and feasibility.

SUMMARY OF THE INVENTION

The present invention has been developed to overcome the above-described disadvantages.

It is accordingly an object of the present invention to provide a sound field offset device which achieves cost reduction as a result of scaling down the major portion of hardware design of digital filter, which allows the sound field to be offset up to a high frequency band, and which presents improved frequency characteristic and makes clear the locality of acoustic images.

To achieve the above object, a sound field offset device according to the present invention has two channels, each of which includes a frequency selection filter for dividing a stereophonic input signal into first and second frequency bands by a given frequency falling within an audio frequency. The first frequency band is higher than the given frequency whereas the second frequency band is lower than the given frequency. Each channel of the sound field offset device also includes analog-to-digital converter means for converting a second frequency band output from the frequency selection filter into a digital signal, at least one digital filter for performing sound field offsetting with respect to an output of the analog-to-digital converter means, and digital-to-analog converter means for converting an output of the digital filter into an analog signal. Each channel further includes delay means for delaying a first frequency band output from the frequency selection filter, adder means for summing an output of the digital-to-analog converter means and an output of the delay means, and at least one loudspeaker assembly having a sharp directivity pattern and capable of defining an area to which acoustic power is emitted within the first frequency band.

In another aspect of the present invention, a sound field offset device includes no adder means. In this case, the sound field offset device preferably includes a second frequency band loudspeaker assembly and at least one first frequency band loudspeaker assembly.

BRIEF DESCRIPTION OF THE DRAWINGS

This and other objects and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

Figure 2:
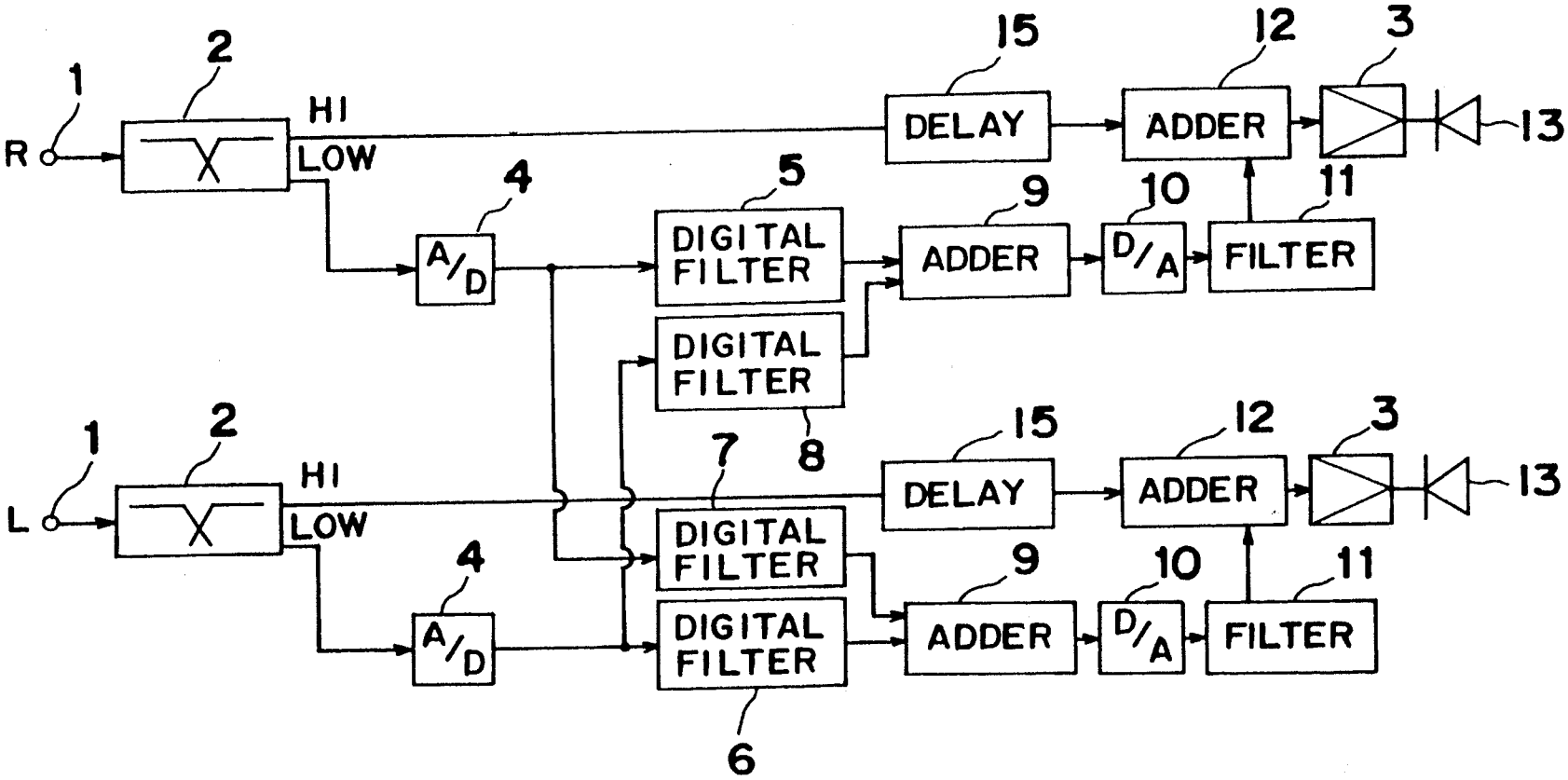
FIG. 2 is a block diagram of a sound field offset device according to a first embodiment of the present invention.

Referring now to the drawings, there is shown in FIG. 2 a sound field offset device according to a first embodiment of the present invention. The sound field offset device comprises input terminals 1, frequency selection filters 2 for dividing input signals into two frequency bands by any frequency f falling within the audio frequency, power amplifiers 3, and analog-to-digital converter means 4 for converting analog signals of a lower frequency band outputted from respective frequency selection filters 2 into digital signals. The sound field offset device also comprises a digital filter 5 having a filter factor required to offset a response at the time a right channel signal reaches the right ear, a digital filter 6 having a filter factor required to offset a response at the time a left channel signal reaches the left ear, a digital filter 7 having a filter factor required to cancel the crosstalk onto the left ear caused by the right channel signal, and a digital filter 8 having a filter factor required to cancel the crosstalk onto the right ear caused by the left channel signal. In the lower frequency band, the filter factor of each of the digital filters 5 and 6 may be so set as to be equivalent to inverse impulse response including reflected sounds of a sound field at a listening point. Each of the digital filters 7 and 8 may have a transfer function for canceling crosstalks between two channels in stereophonic sound reproducing. The sound field offset device further comprises digital adders 9, digital-to-analog converter means 10 for converting digital signals outputted from respective digital adders 9 into analog signals, clock eliminating filters 11, analog adders 12 for providing the sum of the output of respective clock eliminating filters 11 and the higher frequency band output of respective frequency selection filters 2, and a loudspeaker system 13 having a sharp directivity capable of defining an area to which acoustic power, falling on or beyond a frequency f, is emitted.

Described below is how the sound field offset device constructed as above operates. Independently, in each of the left and right channels, input signals applied to the input terminal 1 are divided into two bands according to a dividing frequency f by the frequency selection filter 2. The dividing frequency f is determined by the directivity characteristic of the loudspeaker system 13. This will be detailed later. The lower frequency band outputs of the frequency selection filters 2 are converted into digital signals by respective analog-to-digital converter means 4. Next, the four digital filters 5, 6, 7 and 8 cancel both reflected sound waves in the sound field and the crosstalks between the left and right channels. In each of the left and right channels, the digital adder 9 provides the sum of the outputs of two digital filters, and the sum is then converted back into an analog signal by the digital-to-analog converter means 10. Since the abovementioned digital signal processing is performed over the frequency band below the frequency f, a lower sampling frequency may be used, and arithmetic workload put on the associated logic components are much more alleviated, as compared with a signal processing which would be performed up to the upper limit of the audio frequency. Such an arrangement thus allows the hardware design to be substantially reduced, thereby reducing the manufacturing cost.

The analog outputs provided by the digital-to-analog converter means 10 are fed, via the clock eliminating filters 11, to the analog adders 12 where the analog outputs are added to the higher frequency band outputs given by the frequency selection filters 2. It should be noted that delay means 15 adjusts the outputs of the higher frequency bands of the frequency selection filters 2 so that the timing these outputs reach the adders 12 matches the timing of the outputs of the clock eliminating filters 11. The outputs from the analog adders 12, after being amplified by the power amplifiers 3, are fed to the loudspeaker system 13, to be emitted into the sound field space.

Figure 3:
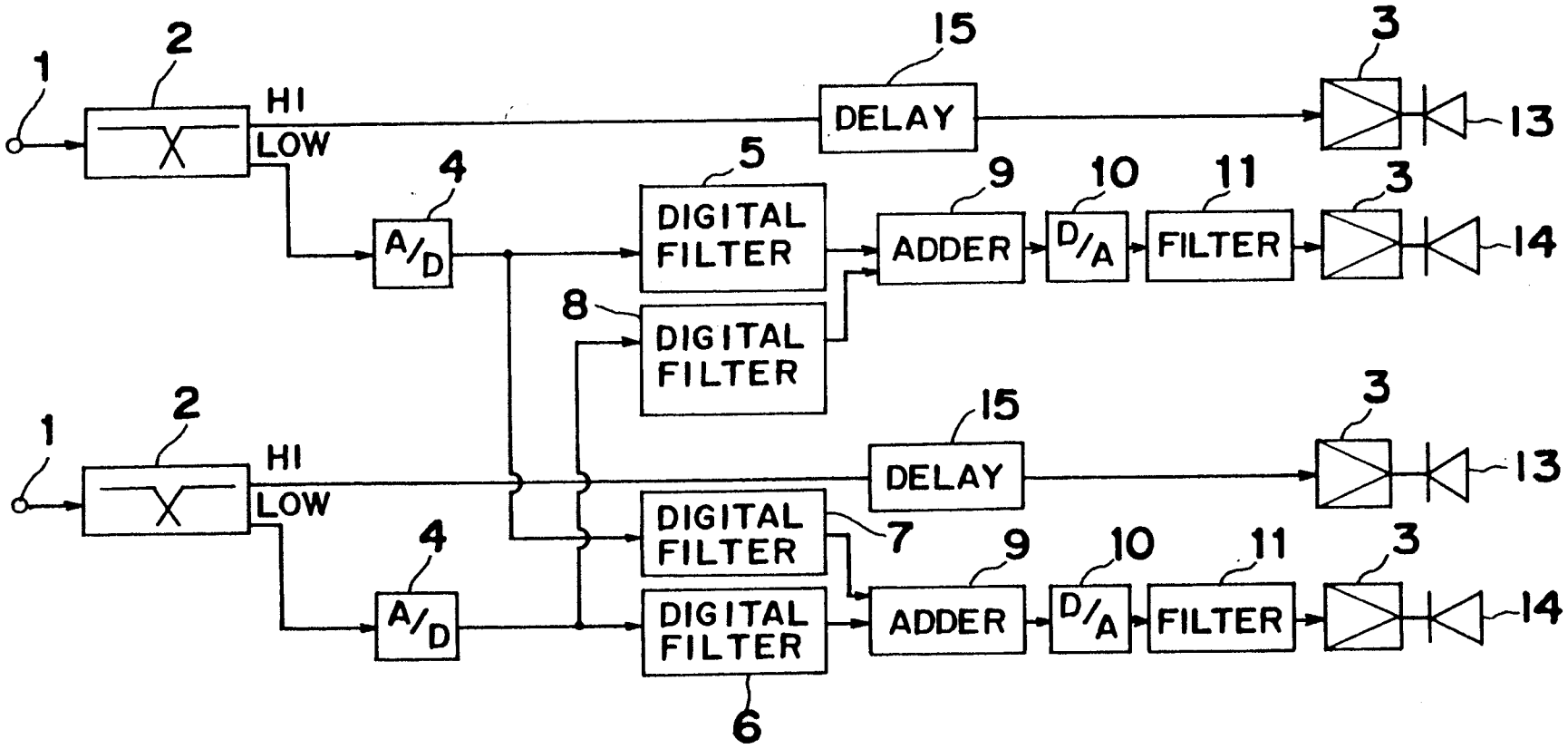
FIG. 3 is a diagram similar to FIG. 2, according to a second embodiment of the present invention.

FIG. 3 depicts a sound field offset device according to a second embodiment of the present invention. Unlike the first embodiment, the sound field offset device of the second embodiment has no analog adders 12 but has a lower audio-frequency loudspeaker system 14, which emits lower frequency band signals already subjected to digital signal processing. The use of the lower audio-frequency loudspeaker system 14 achieves high efficiency and low distortion in sound reproducing in the low audio-frequency band, and furthermore, improves the input characteristic.

Figure 1:
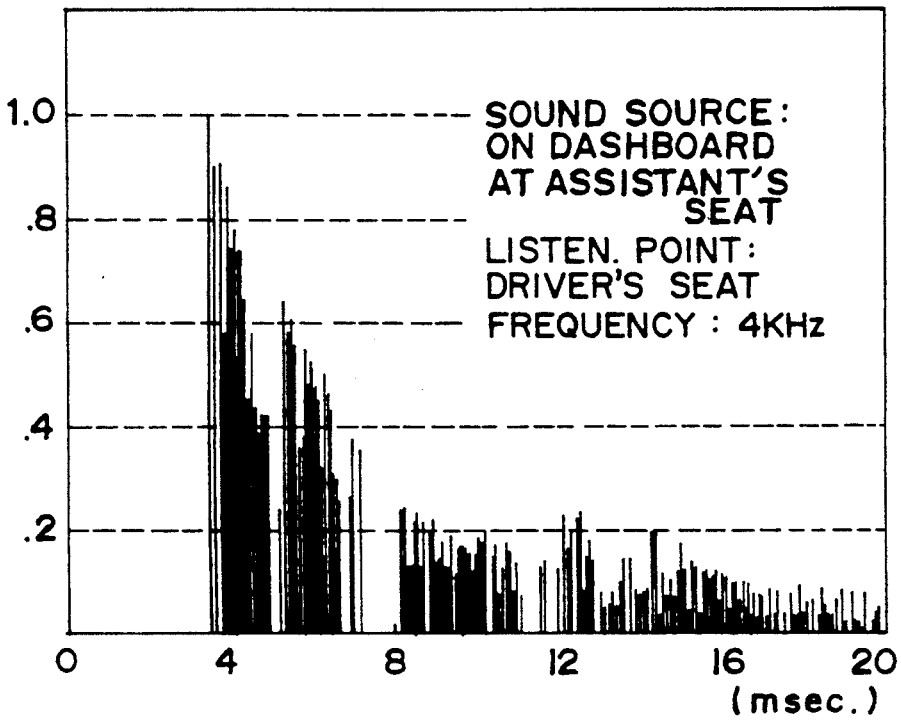
Fig. 1 PRIOR ART
FIG. 1 is a graph indicative of a calculated value of an echo pattern with time in the sound field in a car internal space, obtained from an omnidirectional sound source.
Figure 4:
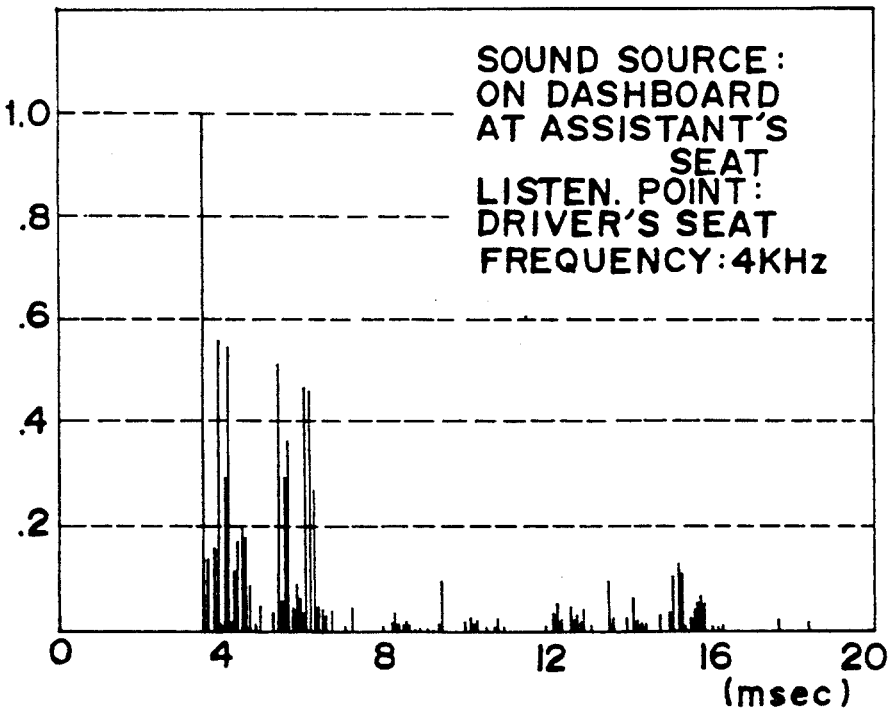
FIG. 4 is a graph similar to FIG. 1, obtained from a sound source with a sharp directivity.

The loudspeaker system 13 is described below. FIG. 4 shows an echo pattern with time, obtained from a sound source with a sharp directivity. The conditions for calculation are identical to those of FIG. 1. In FIG. 4, the pattern of the response changing with time is similar to that in FIG. 1, because the configuration of the sound field space remains unchanged. The level of unwanted reflected waves at the listening point is lowered, because the sharp directivity of the sound source decreases the energy level in the directions off the axis of directivity of the sound source. Sufficiently sharp directivity of the sound source thus lessens the effect of the reflected sound waves.

Figure 5:
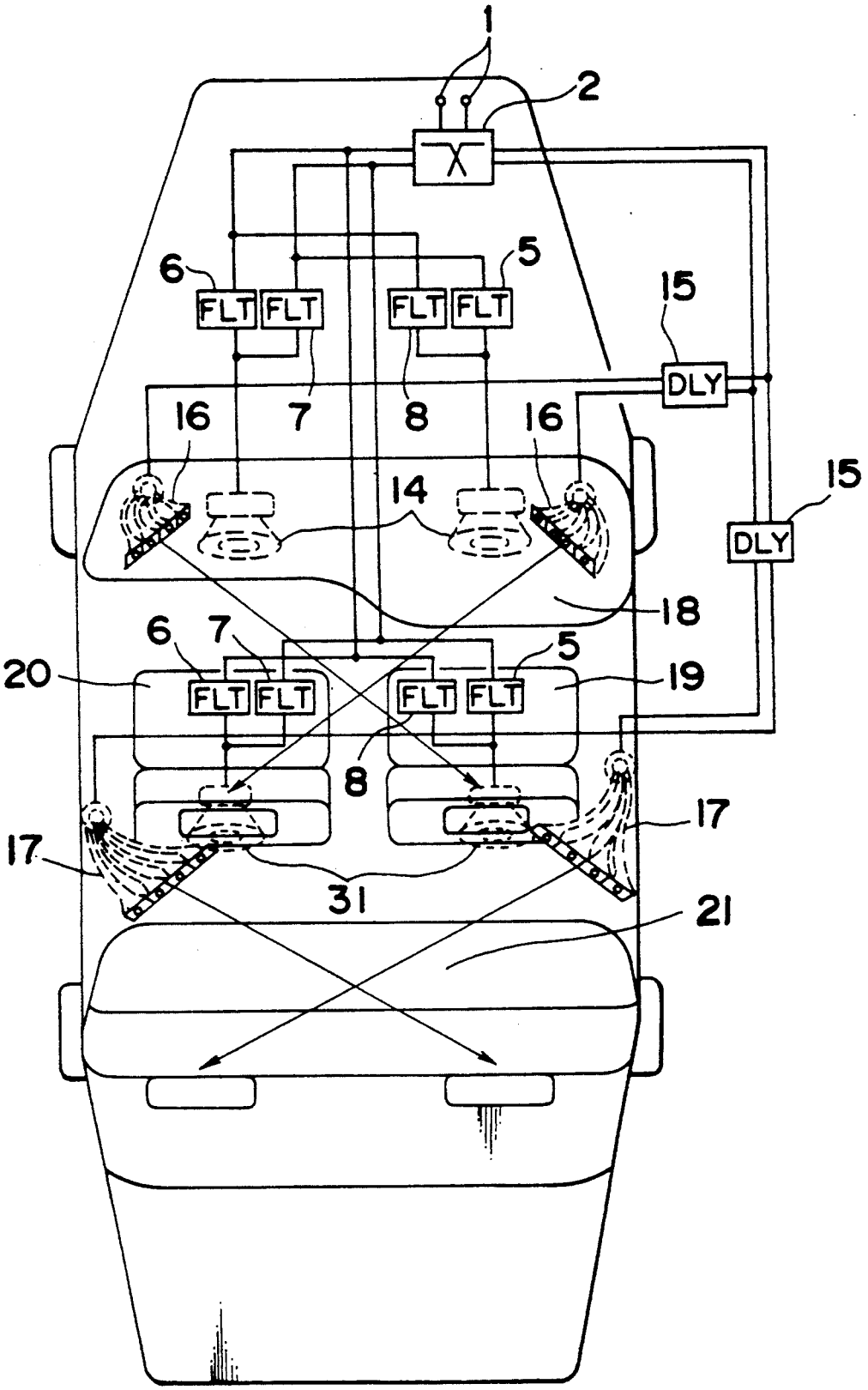
FIG. 5 is a schematic view of a sound field offset device according to the second embodiment of the present invention, which is mounted in a car.

FIG. 5 depicts the layout of an actual loud-speaker system of the sound field offset device according to the second embodiment of the present invention. This loudspeaker system is arranged in a car's internal space and comprises a high audio-frequency loudspeaker system 16 for listeners occupying a driver's seat 19 and an assistant's seat 20, a high audio-frequency loudspeaker system 17 for listeners occupying rear seats 21, a low audio-frequency loudspeaker system 14 for the listeners occupying the front seats 19 and 20, and a low audio-frequency loudspeaker system 31 for the listeners occupying the rear seats 21. Reference numeral 18 denotes a dashboard. As shown in FIG. 5, each of the high audio-frequency loudspeaker system 16 for the front seats 19 and 20 and the high audio-frequency loudspeaker system 17 for the rear seats 21 comprises a pair of right and left loudspeaker assemblies. Also, each of the low audio-frequency loudspeaker system 14 for the front seats 19 and 20 and the low audio-frequency loudspeaker system 31 for the rear seats 21 comprises a pair of right and left loudspeaker assemblies. In FIG. 5, although the sound field offset device has a single frequency selection filter 2, it may have two frequency selection filters 2, as depicted in FIGS. 2 and 3.

The sound field offset device constructed as above operates as follows. Independently, in each of the left and right channels, input signals fed to the stereophonic input terminal 1 are divided into bands by the frequency selection filter 2, according to any dividing frequency f which falls within the audio-frequency. The dividing frequency f is determined by the directivity characteristic of the high audio-frequency loudspeaker systems 16 and 17. This will be detailed later. The low audio-frequency band outputs of the frequency selection filters 2 are fed to the low audio-frequency loudspeaker system 14 and are emitted therefrom into the car's internal space.

Figure 6A:
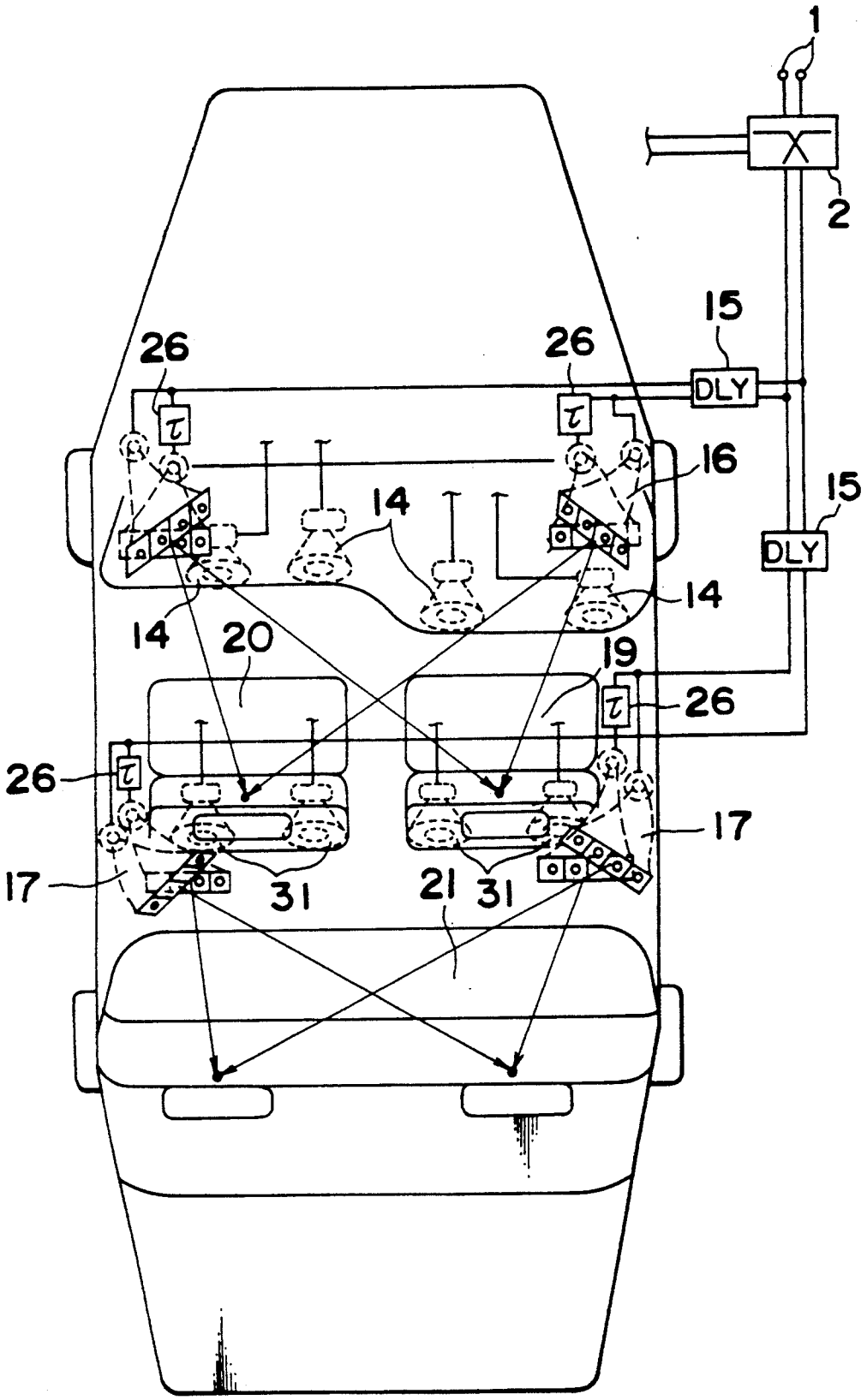
FIG. 6*a* is a view similar to FIG. 5, illustrating another sound field offset device according to the second embodiment of the present invention.
Figure 6B:
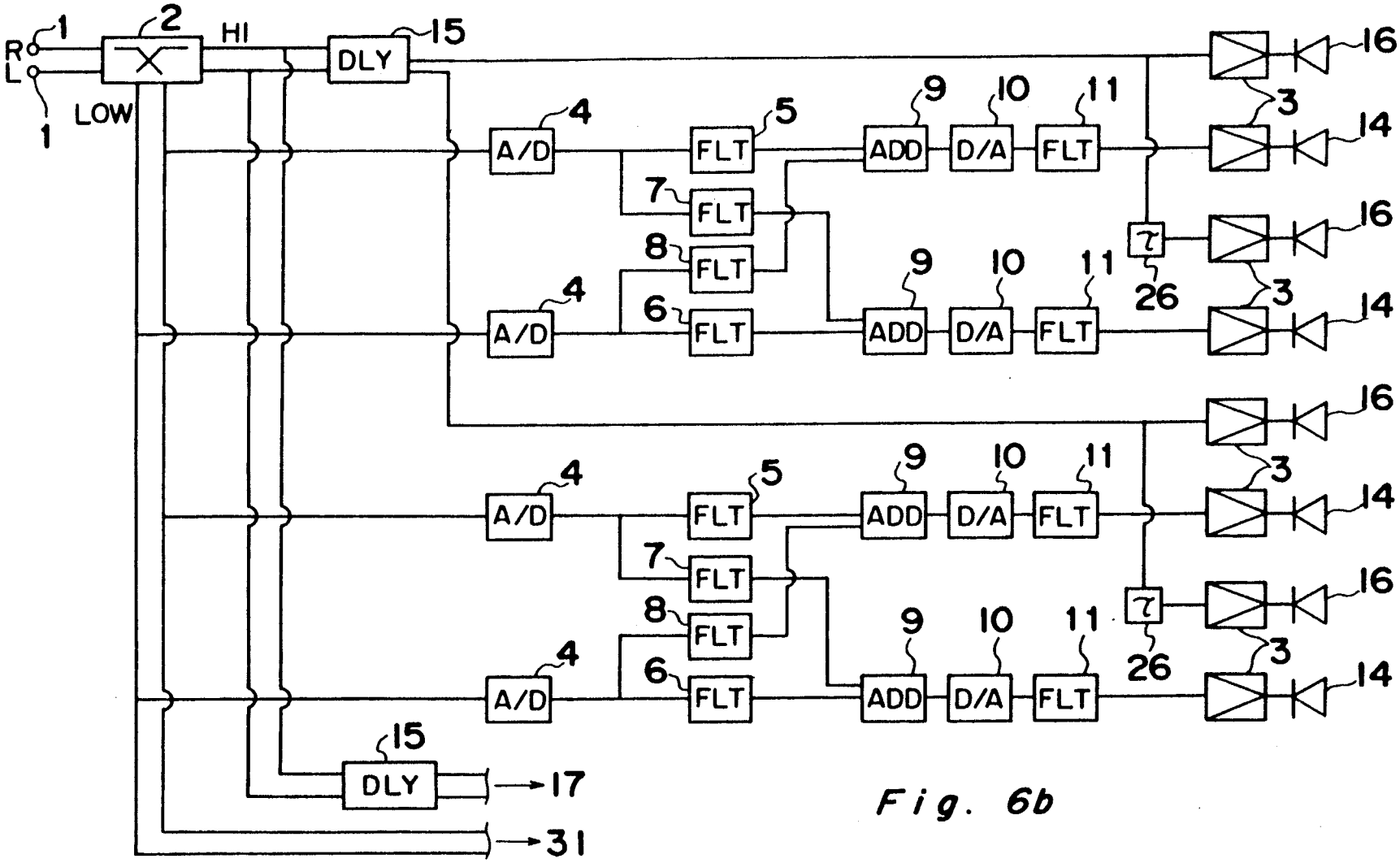
FIG. 6*b* is a block diagram of the sound field offset device of FIG. 6*a*.

FIGS. 6*a* and 6*b* depict another actual loudspeaker system of the sound field offset device according to the second embodiment of the present invention. In the system of FIG. 5, a single high audio-frequency loudspeaker assembly and a single low audio-frequency loudspeaker assembly are directed to each listening point whereas, in the system of FIGS. 6*a* and 6*b*, a pair of high audio-frequency loudspeaker assemblies and a pair of low audio-frequency loudspeaker assemblies are directed to each listening point. In the case of FIGS. 6*a* and 6*b*, of the paired loudspeaker assemblies of the high audio-frequency system, the one located remote from the listening point is provided with an electrical delay means 26 on the input side thereof so that the sound pressure of the right channel and that of the left channel may become equal in phase at the listening point. The detailed explanation of the delay means 26 is omitted here because the function thereof is substantially the same as that of a delay means as discussed later. Furthermore, the high audio-frequency loudspeaker system 17 and the low audio-frequency loudspeaker system 31 are omitted from the block diagram of FIG. 6*b* because these loudspeaker systems 17 and 31 are the same in construction as the high audio-frequency loudspeaker system 16 and the low audio-frequency loudspeaker system 14, respectively.

Figure 7:
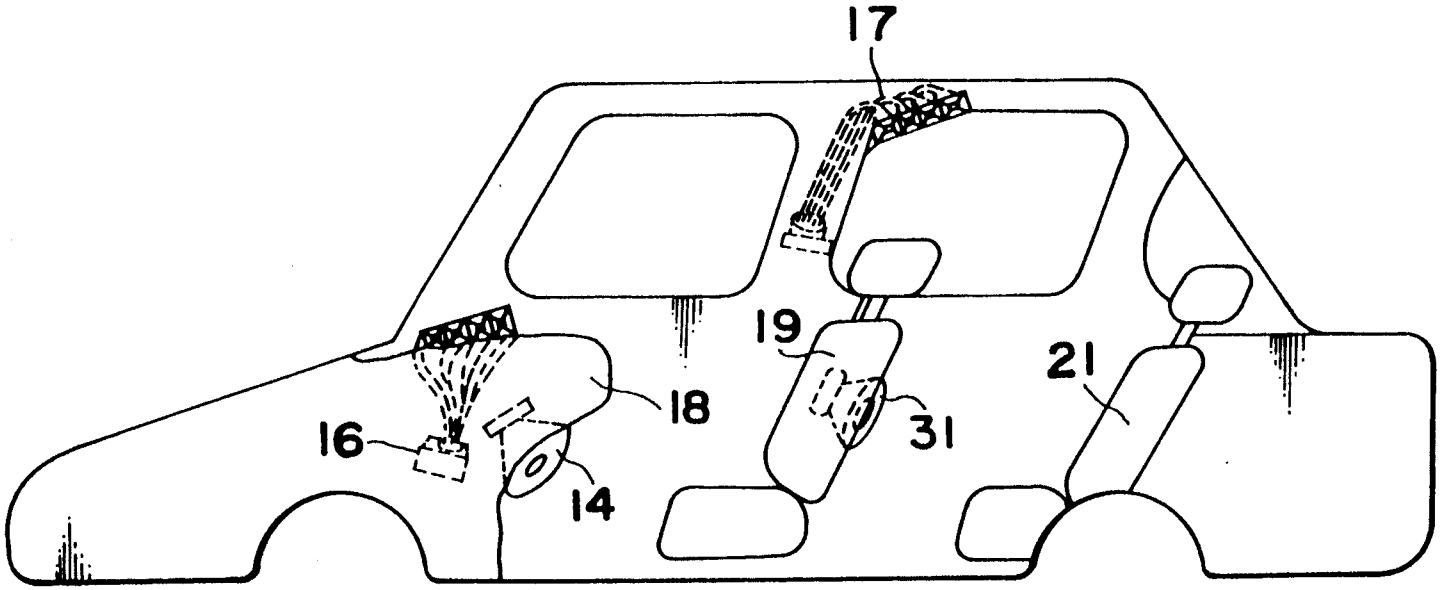
FIG. 7 is a schematic view indicative of the arrangement of a loudspeaker system in the car.

As shown in FIG. 7, according to this embodiment, the loudspeaker assemblies of the low audio-frequency loudspeaker system 14 for the front seats 19 and 20 are mounted in a lower portion of the dashboard 18 whereas those of the low audio-frequency loudspeaker system 31 for the rear seats 21 are mounted in backrests of the driver's seat 19 and the assistant's seat 20.

The high audio-frequency band outputs given by the frequency selection filters 2 are fed to both the high audio-frequency loudspeaker system 16 for listeners occupying the front seats 19 and 20 and the high audio-frequency loudspeaker system 17 for listeners occupying the rear seats 21, in order that the outputs are thus emitted in sound into the car's internal space. It is to be noted that both the high audio-frequency loudspeaker systems 16 and 17 are electrically connected in parallel with each other. The high audio-frequency loudspeaker system 16 for the front seat listeners are embedded in the dashboard 18 whereas the high audio-frequency loudspeaker system 17 for the rear seat listeners are embedded in a ceiling portion of the car.

Figure 8:
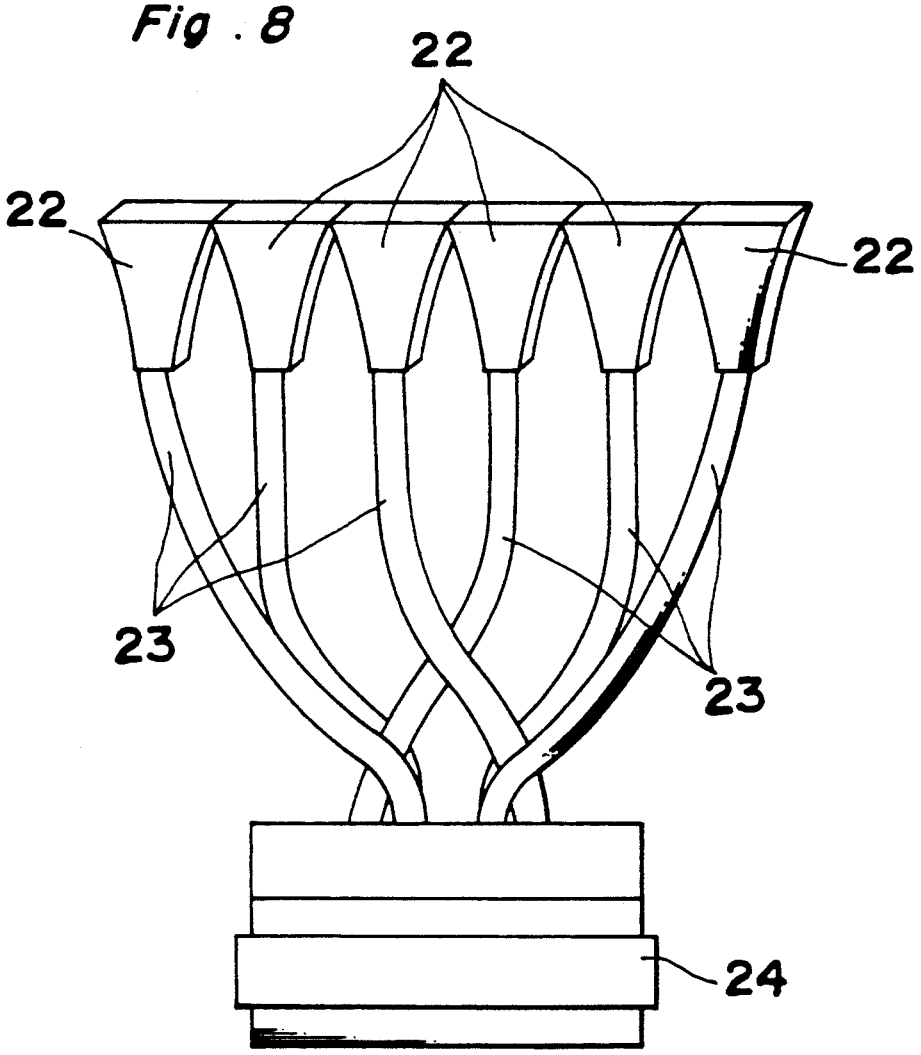
FIG. 8 is a schematic view of a loudspeaker assembly of the loudspeaker system.

FIG. 8 shows the detailed configuration of one of loudspeaker assemblies employed in both the high audio-frequency loudspeaker system 16 for the front seat listeners and the high audio-frequency loudspeaker system 17 for the rear seat listeners. The loudspeaker assembly is provided with a plurality of rectangular horn apertures 22 equally spaced on a linear arrangement, a plurality of horns 23 connected with respective horn apertures 22, and a horn driver 24 connected with all the horns 23. The horns 23 transfer acoustic power from the horn driver 24. Sound pressure generated by the single horn driver 24 is emitted from the horn apertures 22 via respective horns 23. If the horns 23 are of equal length, the sound waves emitted from the horn apertures 22 are also equal in phase, thereby making sharp the directivity of sounds in the direction in which all the horn apertures 22 are aligned.

Figure 9:
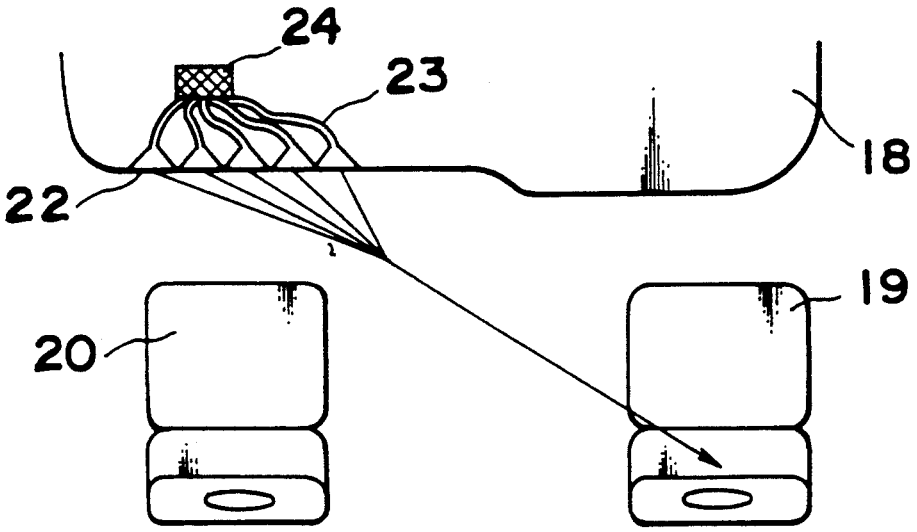
FIG. 9 is a schematic view of a modification of the loudspeaker assembly.

FIG. 9 shows a modification of the loudspeaker assembly employed in both the high audio-frequency loudspeaker system 16 for the front seat listeners and the high audio-frequency loudspeaker system 17 for the rear seat listeners. The loudspeaker assembly shown in FIG. 9 is the one for the driver's seat 19. Unlike the loudspeaker assembly shown in FIG. 8, the loudspeaker assembly shown in FIG. 9 shows a sharp directivity in the direction indicated by the arrow because each of the horns 23 is increasingly longer as its aperture 22 is nearer the driver's seat 19, and thus, the sound pressures emitted out of the horn apertures 22 are different in phase with each other. In this arrangement, the horn apertures 22 are not necessarily required to be directed toward the listening point but may be mounted so that it may fit into the configuration of the dashboard 18, and the lengths of the horns 23 may be properly adjusted later.

The above construction provides more flexibility in mounting the horn driver 24, which needs a relatively large mounting space. In other words, the horn driver 24 may be mounted in a desired space available inside the car rather than in immediate front of the front seat, thereby alleviating restrictions in placement of the loudspeaker assembly inside the car's internal space. Acoustic power is routed, via the horns 23, from the mounting position of the horn driver 24 to the horn apertures 22. The horn apertures 22 may be mounted at an acoustically preferable location so that acoustic power is appropriately emitted therefrom into the car's internal space.

Figure 10:
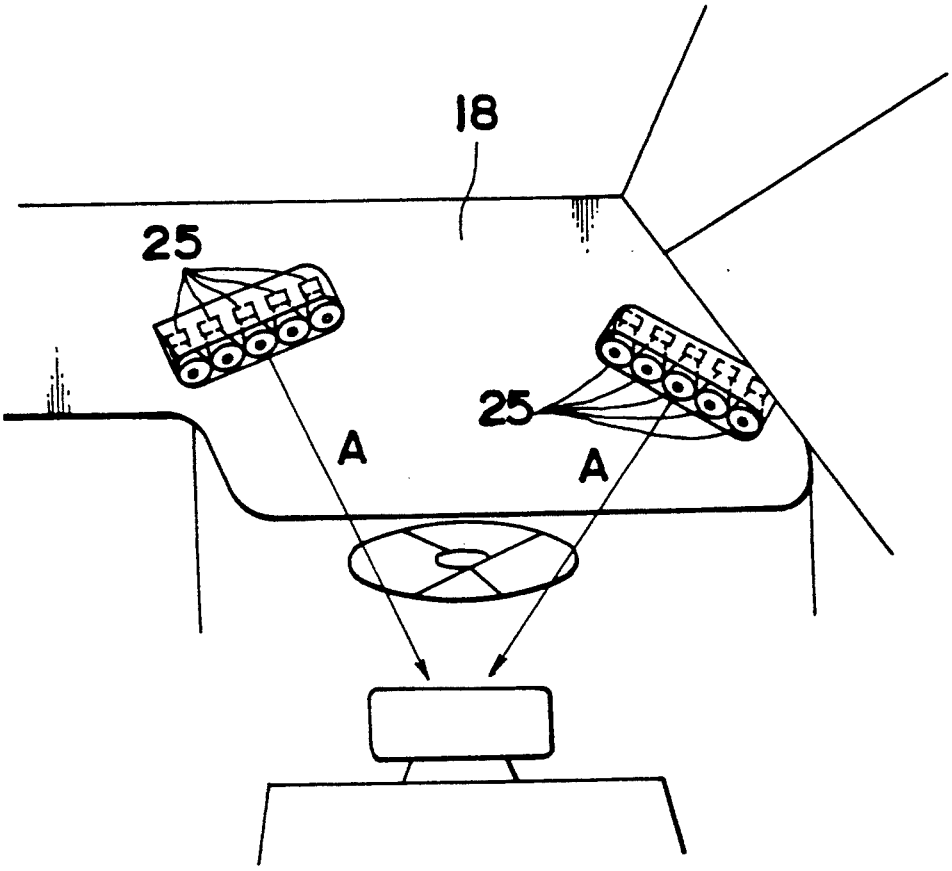
FIG. 10 is a schematic view of a second modification of the loudspeaker assembly.

FIG. 10 shows a second modification of the loudspeaker assembly with a sharp directivity. The loudspeaker assembly shown in FIG. 10 is provided with a plurality of linearly aligned driver units 25 equally spaced from each other. The driver units 25 are driven at the same phase and the same amplitude. In this case, the axis of directivity agrees with the direction A normal to the line along which the driver units 25 are aligned. Two loudspeaker assemblies shown in FIG. 10 are both embedded in the dashboard 18 so that their axes of directivity join at the listening point.

Figure 11:
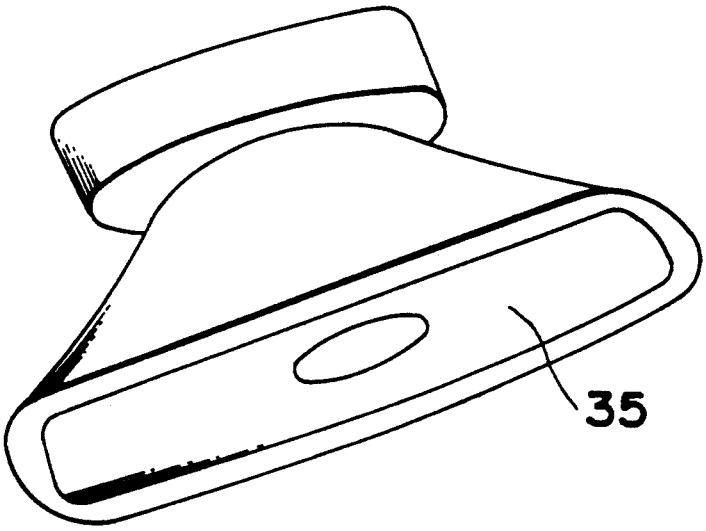
FIG. 11 is a schematic view of a third modification of the loudspeaker system.

Each of the loudspeaker assemblies shown in FIG. 10 may be replaced by a loudspeaker assembly having a rectangular diaphragm 35 as shown in FIG. 11. The configuration of the diaphragm is not limited to the configuration shown in FIG. 11, and any elongated configuration such as, for example, an ellipse may be employed.

Figure 12:
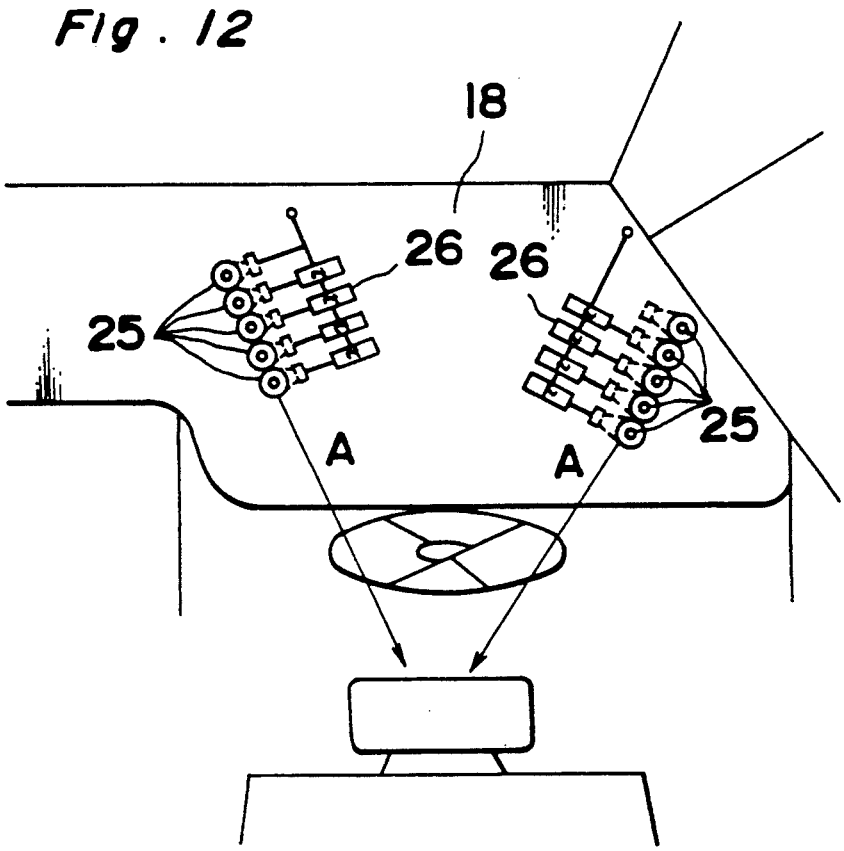
FIG. 12 is a schematic view of a fourth modification of the loudspeaker assembly.

FIG. 12 shows a third modification of the loudspeaker assembly with a sharp directivity. The loudspeaker assembly shown in FIG. 12 is provided with a plurality of linearly aligned driver units 25 equally spaced from each other and a plurality of electrical delay means 26 arranged on the input sides of respective driver units 25 except a single driver unit farthest from the listening point. Both the driver units 25 and the delay means 26 are embedded in the dashboard 18. The delay time of the delay means 26 is so set that the sound pressure of a sound wave emitted from each unit becomes equal in phase at a location in the proximity of the unit 25 nearest to the listening point, and thus, the combined sound pressure is maximized there. Specifically, assuming that spacing between two neighboring units is d and the speed of sound is c, delay time $t_n$ required for n-th unit from the one farthest from the listening point in the units with respective delay means 26 is expressed as follows:

$$t_n = n \times d/c \quad (3)$$

In this case, because the axis of directivity of the loudspeaker assembly agrees with the direction A, the loudspeaker assembly provides its sharp directivity toward the listening point if the loudspeaker assembly is arranged so that the line of array of the driver units 25 meet the listening point.

Figure 13:
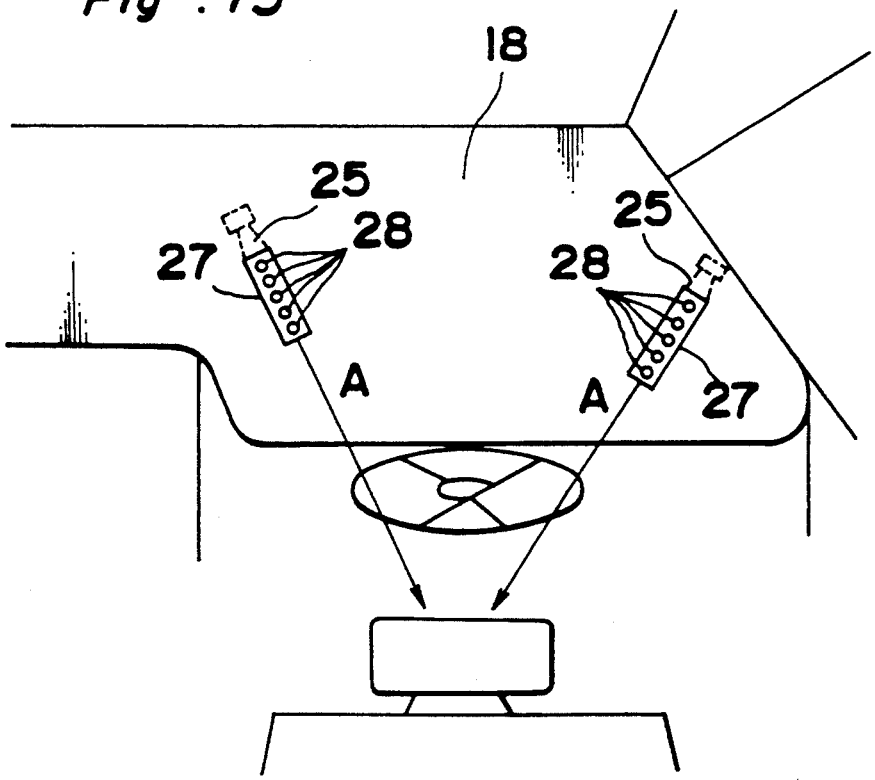
FIG. 13 is a schematic view of a fifth modification of the loudspeaker assembly.

FIG. 13 shows a fourth modification of the loudspeaker assembly with a sharp directivity. The loudspeaker assembly shown in FIG. 13 is provided with a driver unit 25 embedded in the dashboard 18 and an acoustic tube 27 having a plurality of equally spaced holes 28 formed linearly at its side wall. The driver unit 25 is connected with one end of the acoustic tube 27. Because the holes 28 of the acoustic tube 27 act as a sound source, the axis of directivity of the loudspeaker assembly agrees with the direction A. If the loudspeaker assembly is mounted in a manner that the longitudinal axis of the acoustic tube 27 meet the listening point, a sharp directivity is obtained in the direction toward the listening point.

The description that follows is the merit of the use of the loudspeaker system having a sharp directivity in the sound field in a car's internal space.

Figure 14:
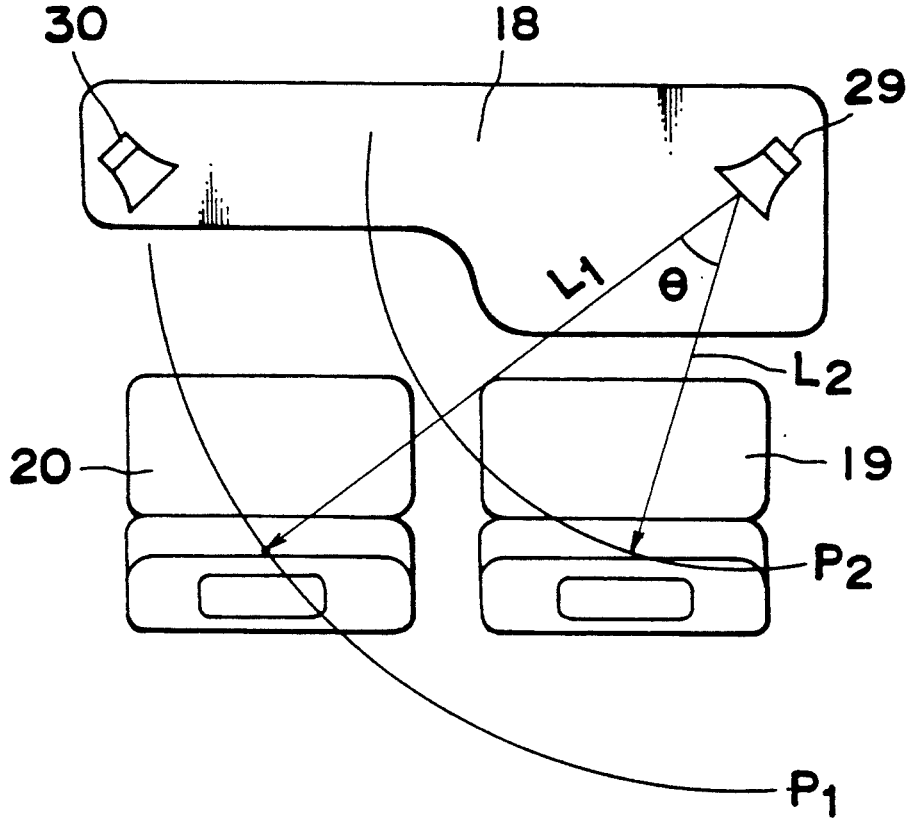
FIG. 14 is a diagram indicative of sound pressure contours in the car, caused by an omnidirectional loudspeaker.

In FIG. 14, reference numerals 29 and 30 denote a loudspeaker mounted in front of the driver's seat 19 and a loudspeaker mounted in front of the assistant's seat, respectively. L1 is the distance between the loudspeaker 29 located in front of the driver's seat 19 and the listening point at the assistant's seat 20. $\theta$ indicates the angle between the line segment connecting the loudspeaker 29 to the listening point at the assistant's seat 20 and the line segment connecting the loudspeaker 29 to the listening point at the driver's seat 19. P1 indicates the sound pressure contour which is obtained by connecting points where the direct sound pressure emitted from the loudspeaker 29 is P1. P2 indicates the sound pressure contour which is obtained by connecting points where the direct sound pressure emitted from the loudspeaker 29 is P2.

If the loudspeaker 29 is of an omnidirectional type, the sound pressure contour spreads concentrically about the loudspeaker 29, as shown in FIG. 14. The sound pressure P1 at the listening point of the assistant's seat 20 remote from the loudspeaker 29 is smaller than the sound pressure P2 at the listening point of the driver's seat 19. The sound pressure difference between these two points is expressed as follows:

$$P1 - P2 = 20 \text{ Log}_{10} (L2/L1) \quad (1)$$

Similarly, if the loudspeaker 30 located on the side of the assistant's seat 20 is mounted at a symmetrical position across the dashboard 18 with respect to the loudspeaker 29, the distance between the loudspeaker 30 and the listening point of the driver's seat 19 is L1. Accordingly, the sound pressure derived from the loudspeaker 30 becomes P1 at the listening point of the driver's seat 19. Because of this, the sound pressure difference as expressed by the equation (1) also takes place between the left channel and right channel, thereby shifting acoustic images to the right hand side where the sound pressure level is higher.

Figure 15:
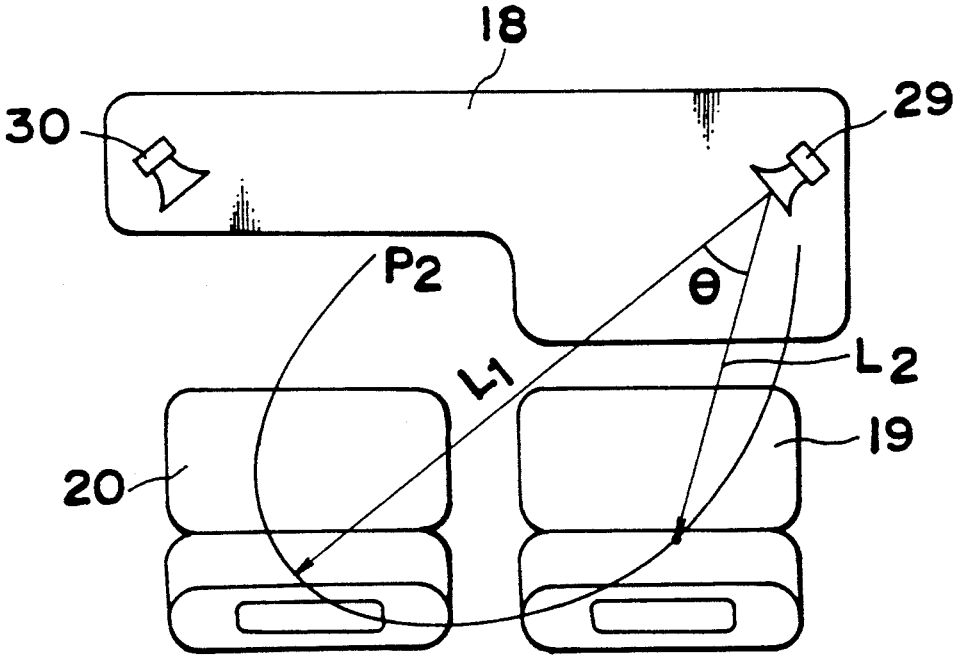
FIG. 15 is a diagram indicative of sound pressure contours in the car, caused by a directional loudspeaker.

In FIG. 15, however, the loudspeaker 29 has a sharp directivity and the sound pressure contour P2 derived therefrom passes both the listening points at driver's seat 19 and the assistant's seat 20. Accordingly, both the sound pressure of direct sound waves emitted from the loudspeaker 29 and that of direct sound waves emitted from the loudspeaker 30 becomes P2. As a result, the sound pressure difference between the left channel and right channel becomes zero, and acoustic images are located in front of the listener.

A design example of a loudspeaker having the directivity pattern as illustrated in FIG. 15 is now described. In FIG. 15, assuming L1=1260 mm, L2=840 mm, $\theta = 35°$, the sound pressure difference (dB) between the sound pressure at the listening point of the driver's seat 19 and that at the listening point of the assistant's seat 20 is determined as follows using the equation (1):

$$P1 - P2 = 20 \text{ Log}_{10} (1260/840) = 3.52 \quad (2)$$

Figure 16:
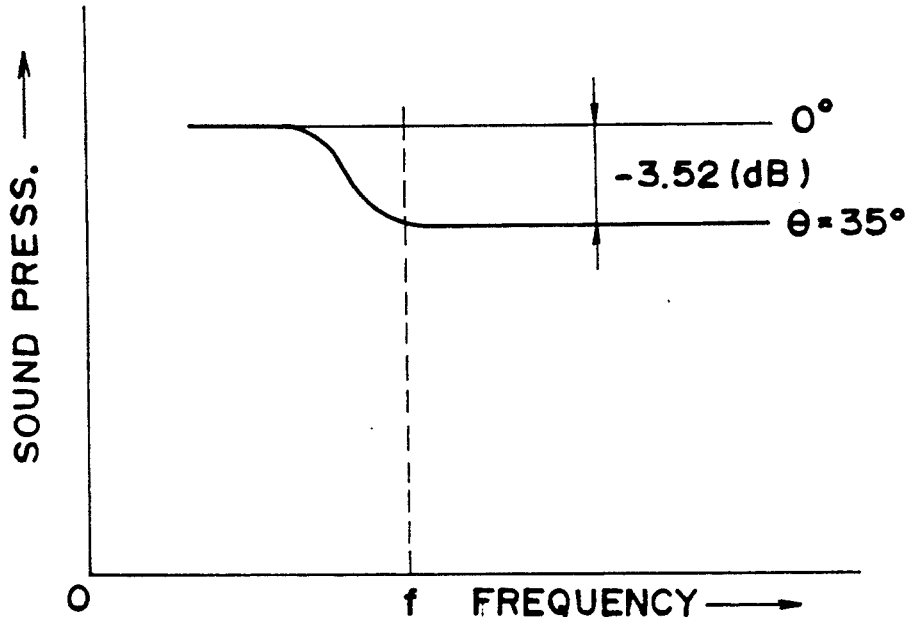
FIG. 16 is a graph indicative of the theoretical frequency characteristic of the directional loudspeaker.

Accordingly, as shown in FIG. 16, the directivity pattern the directivity controlled loudspeaker needs may be obtained if the sound pressure level at 35° off the axis of directivity of the loudspeaker is −3.52 (dB) relative to the sound pressure level on the axis of directivity in the frequency band used for the directivity controlled loud-speaker. Therefore, a lower limit frequency which provides the sound pressure difference between the sound pressure on the axis of directivity and that in the directions off 35° ($\theta = 35°$) may be adopted as a dividing frequency f of the frequency selection filter 2.

Figure 17:
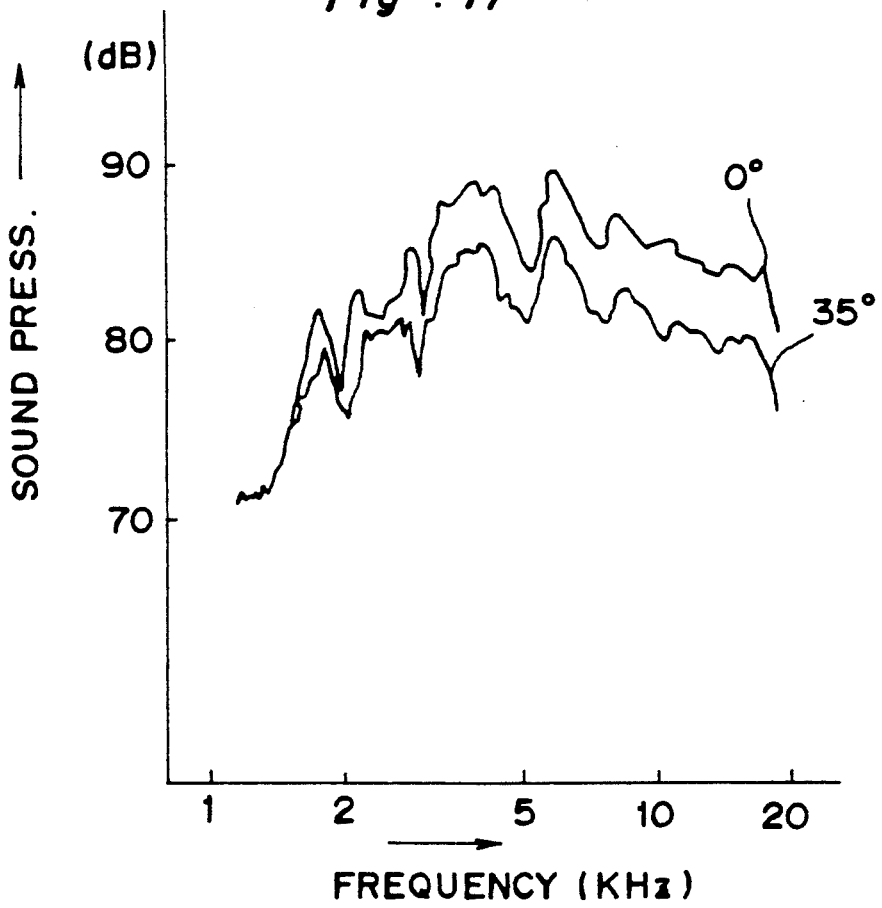
FIG. 17 is a graph indicative of actually measured frequency characteristic of the directional loudspeaker.

FIG. 17 shows actually measured sound level versus frequency characteristics on the axis of directivity and in the directions 35° off the axis of directivity, in connection with the directivity controlled loudspeaker designed as described above. Desired directivity is achieved over the frequency band beyond about 3 kHz.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A sound field offset device having two channels, each of which comprises:

a frequency selection filter for dividing a stereophonic input signal into first and second frequency bands by a given frequency falling within an audio frequency, said first frequency band being higher than said given frequency, said second frequency band being lower than said given frequency;

analog-to-digital converter means for converting a second frequency band output from said frequency selection filter into a digital signal;

at least one digital filter for performing sound field offsetting with respect to an output of said analog-to-digital converter means;

digital-to-analog converter means for converting an output of said digital filter into an analog signal;

delay means for delaying a first frequency band output from said frequency selection filter;

adder means for summing an output of said digital-to-analog converter means and an output of said delay means; and at least one loudspeaker assembly having a sharp directivity pattern for defining an area to which acoustic power is emitted within said first frequency band with a substantially uniform sound pressure level, the one loudspeaker assembly having an axis of directivity, wherein selection of said given frequency is substantially dictated by a sound pressure difference between a first listening point located on the axis of directivity and a second listening point off the axis of directivity and outside of said area.

2. The sound field offset device according to claim 1, wherein said device comprises a pair of right and left loudspeaker assemblies for a listening point at a driver's seat and a pair of right and left loudspeaker assemblies for a listening point at an assistant's seat in a car.

3. The sound field offset device according to claim 1, wherein said device comprises two pairs of right and left loudspeaker assemblies for listening points at front seats and two pairs of right and left loudspeaker assemblies for listening points at rear seats in a car.

4. A sound field offset device according to claim 1, wherein, if the sound pressure difference is represented by a variable SPD and measured in decibels (db), the given frequency is selected such that a sound pressure level at the second listening point is negative SPD (db) relative to that along the axis of directivity.

5. A sound field offset device according to claim 1 further comprising a second frequency band loudspeaker assembly for emitting an output of said digital-to-analog converter means.

6. The sound field offset device according to claim 1, wherein said loudspeaker assembly comprises a plurality of horns each having a rectangular aperture.

7. The sound field offset device according to claim 1, wherein said loudspeaker assembly comprises a single horn driver and a plurality of horns for transferring acoustic power from said horn driver.

8. The sound field offset device according to claim 7, wherein said plurality of horns differ in length.

9. The sound field offset device according to claim 1, wherein said loudspeaker assembly comprises a plurality of linearly aligned and equally spaced driver units.

10. The sound field offset device according to claim 9, wherein each of said driver units except a single driver unit farthest from a listening point has a delay means on an input side thereof.

11. The sound field offset device according to claim 1, wherein said loudspeaker assembly comprises an acoustic tube and a driver unit connected to one end of said acoustic tube, said acoustic tube having a plurality of equally spaced holes formed linearly at a side wall thereof.

12. The sound field offset device according to claim 5, wherein said loudspeaker assembly comprises a plurality of horns each having a rectangular aperture.

13. The sound field offset device according to claim 5, wherein said loudspeaker assembly comprises a single horn driver and a plurality of horns for transferring acoustic power from said horn driver.

14. The sound field offset device according to claim 13, wherein said plurality of horns differ in length.

15. The sound field offset device according to claim 5, wherein said loudspeaker assembly comprises a plurality of linearly aligned and equally spaced driver units.

16. The sound field offset device according to claim 15, wherein each of said driver units except a single driver unit farthest from a listening point has a delay means on an input side thereof.

17. The sound field offset device according to claim 5, wherein said loudspeaker assembly comprises an acoustic tube and a driver unit connected to one end of said acoustic tube, said acoustic tube having a plurality of equally spaced holes formed linearly at a side wall thereof.

* * * * *